US005670104A

United States Patent [19]

Miura et al.

[11] Patent Number: 5,670,104

[45] Date of Patent: Sep. 23, 1997

[54] METHOD FOR CUTTING UNDRIED CLAY MATERIAL

[75] Inventors: Yasunao Miura; Mamoru Nishimura, both of Nagoya; Kojiro Tokuda, Kariya, all of Japan

[73] Assignee: Nippondenso Co., Ltd., Kariya, Japan

[21] Appl. No.: 383,523

[22] Filed: Feb. 3, 1995

[30] Foreign Application Priority Data

Feb. 4, 1994 [JP] Japan ..... 6-012337
Nov. 22, 1994 [JP] Japan ..... 6-288381

[51] Int. Cl.[6] ..... B28B 11/16

[52] U.S. Cl. ..... 264/145; 264/177.12; 83/53; 83/177

[58] Field of Search ..... 83/53, 177; 264/145, 264/177.12

[56] References Cited

FOREIGN PATENT DOCUMENTS

| | | |
|---|---|---|
| 60-110405 | 6/1985 | Japan . |
| 61-056899 | 3/1986 | Japan . |
| 61-56899 | 3/1986 | Japan . |
| 4-57675 | 2/1992 | Japan . |

*Primary Examiner*—David W. Wu
*Attorney, Agent, or Firm*—Cushman, Darby & Cushman IP Group of Pillsbury Madison & Sutro LLP

[57] ABSTRACT

A method for cutting an extruding honeycomb structure by a jet of high pressure water. The jet is controlled in position to assure a smooth, straight cut perpendicular to the extruding direction.

7 Claims, 3 Drawing Sheets

METHOD FOR CUTTING UNDRIED CLAY MATERIAL

The present invention is based on and claims priority from Japanese Application Nos. 6-12337 filed on Feb. 4, 1994 and 6-288381 filed on Nov. 22, 1994, the subject matter of which is hereby incorporated herein by reference.

BACKGROUND OF THE INVENTION

1. Field of the Invention

The present invention relates to a method and apparatus for cutting undried clay material for a honeycomb-shaped ceramic body used for a diesel particulate filter, heat exchanger, etc., by injecting high pressure water from a minute nozzle.

2. Related Art

Conventionally, a method for cutting a honeycomb-shaped ceramic body such as shown in Japanese patent publication No. 4-60402 is well known. In such a method, a honeycomb-shaped ceramic body used for a catalytic substrate, diesel particulate filter, a heat exchanger, etc. is cut by using a wire made of metal such as piano wire. However, in the above cutting method, when the diameter of the wire is increased, the body is deformed due to its resistance to cutting. If on the other hand the diameter of the wire is decreased, the wire is easily broken. Either way the number of defective products increases.

In addition, when the above method is applied to an undried clay material for a honeycomb-shaped ceramic body used for a catalyst substrate, a diesel particulate filter, a heat exchanger, etc., especially one having a thin ceramic wall for reducing pressure loss, the above problem becomes greater because of the thinness of the wall.

As a result, deformation of the honeycomb-shaped ceramic body occurs frequently; especially the cross sectional shape, such as the rectangular shape of cell units, which not only deforms but also crushes and causes crushing of other cells.

The present invention is made in view of the above problems, and a purpose of the present invention is to provide a cutting apparatus and method for cutting the undried clay material of a honeycomb-shaped ceramic body which are capable of reducing the occurrence of defective products.

Cutting an undried clay material for a honeycomb-shaped ceramic body used for a catalytic substrate, diesel particulate filter, a heat exchanger, etc. by injecting high pressure water from a minute nozzle has not been known so far in the prior art. The apparent reason is based on a preconceived idea that water remaining in the cell near the cutting portion after cutting an undried clay material for a honeycomb-shaped ceramic body causes the clay to soften and deform, making it hard to maintain its predetermined shape. To solve the above problem, the inventors have studied diligently without being deterred by the preconceived idea, and the result is described in detail below.

SUMMARY OF THE INVENTION

In general, the invention is directed to cutting an extruding undried honeycomb structure with a jet of high pressure water so that the cut leaves smooth surfaces and is perpendicular to the extruding direction. To accomplish this a high pressure water injection nozzle traverses the honeycomb structure at an acute angle to the extruding direction, and the speed of the traversal is controlled in dependence on the speed of the extrusion of the honeycomb structure. The nozzle may also be movable in the extruding direction in dependence on the speed of the extrusion of the honeycomb structure. Both apparatus and method are described to implement the invention.

BRIEF DESCRIPTION OF THE DRAWINGS

Other objects, features and characteristics of the present invention as well as the functions of related parts will become clear from a study of the following detailed description, the appended claims, and the drawings. In the accompanying drawings:

DETAILED DESCRIPTION OF THE PREFERRED EMBODIMENTS

An embodiment according to the present invention is described with respect to the drawings.

Figure 1A:
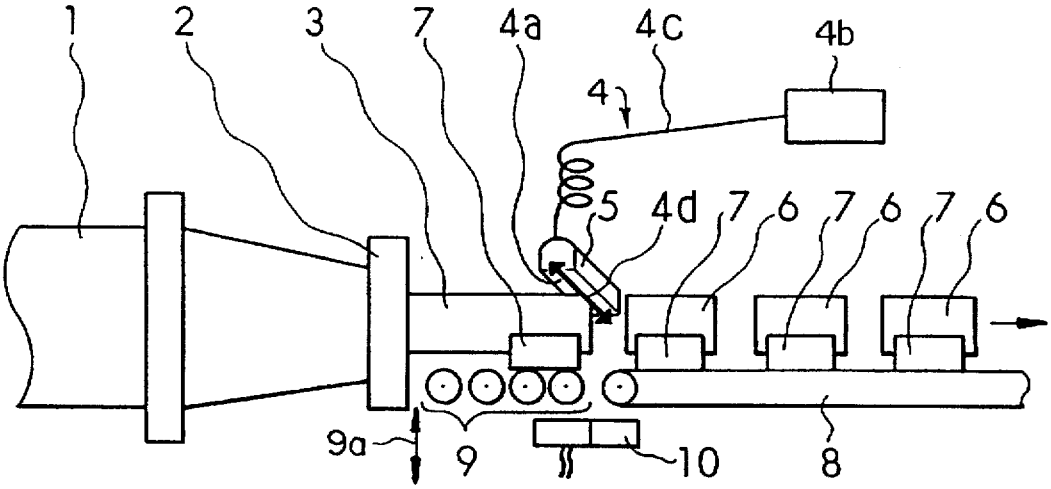
FIG. 1A is a side view diagrammatically showing an embodiment according to the present invention.
Figure 1B:
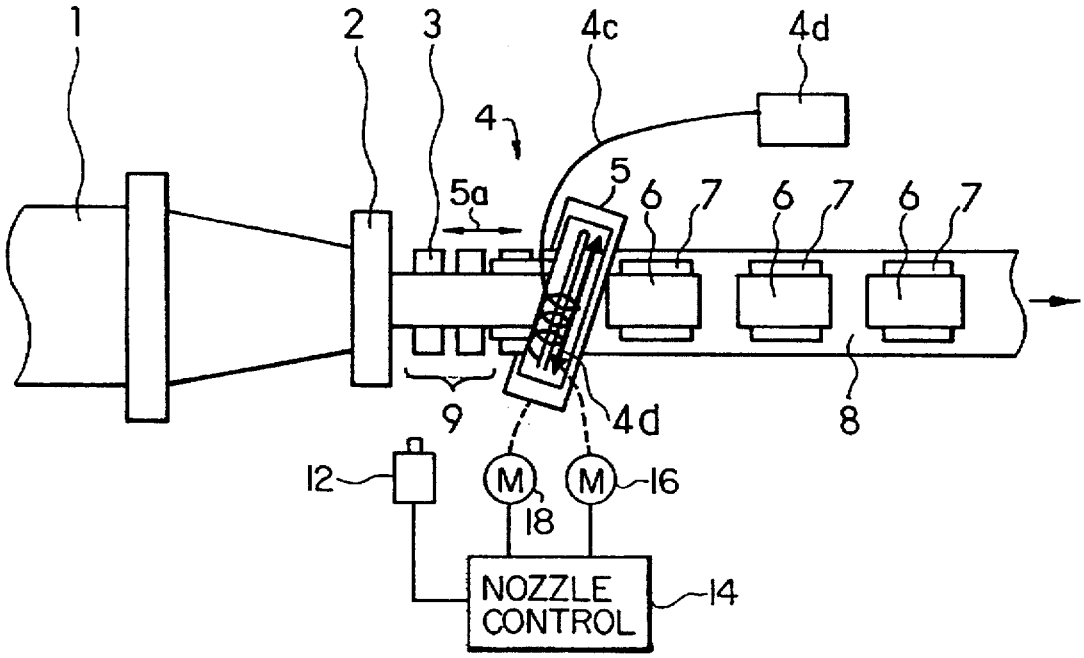
FIG. 1B is a top view of FIG. 1A.

FIGS. 1A and 1B are front and plan views, respectively, for explaining the apparatus and method for making a honeycomb body according to the present invention.

In FIGS. 1A and 1B, forming machine 1 forms an undried clay material from a ceramic raw material. Die 2 is mounted on forming machine 1 for forming a honeycomb structure 3 of the undried clay material. As extruded, the honeycomb structure rests on and is held by a receiving stand 7 which in turn rests on a transporting mechanism including a set of idler rollers 9.

A high pressure water injection cutting machine 4 operates as a high pressure water injecting means. Cutting machine 4 includes a high pressure water injection nozzle **4*a* for injecting water with high pressure, a high pressure water generating pump 4*b* for generating high water pressure, and a tube 4*c* for leading high pressure water from pump 4*b* to nozzle 4*a***.

A movable nozzle holding device 5 which is positioned at a predetermined angle relative to the extrusion direction has mounted under it the water injection nozzle **4*a*. Nozzle 4*a* is movable in track in holder 5 running in the direction of arrows 4*d* so as to make a straight cut across the undried honeycomb structure 3 by a jet of water injected from nozzle 4*a* at an acute angle relative to the extruding direction of the undried honeycomb structure 3. That produces a cut honeycomb body 6 which continues to ride in its respective receiving stand 7. The extruded honeycomb structure 3 pushes the cut body forward and its receiving stand 7 moves onto conveyor 8** for transferring the cut bodies to a drying machine, for example.

It is to be understood that instead of the nozzle **4*a* being movable in holder 5, it may be fixed therein and the holder moved in the same manner as explained for nozzle 4*a***.

Movement of the high pressure water injection nozzle **4*a*** is now described.

In order to make a straight cut across the honeycomb structure 3 perpendicular to the extrusion direction, the speed of movement of nozzle 4a (downward in FIG. 1B) must be correlated with the speed of the extrusion since the extruding speed is not always constant. Sensor 12 senses the extruding speed and sends a signal to nozzle control device which in turn controls the speed of motor 16 which moves nozzle 4a. If desired, nozzle holder 5 can also be moved along the extruding direction as shown by arrows 5a under the control of nozzle control device 14 by motor 18. Device 14 also operates to recycle nozzle 4a back to its starting position, at the top of arrows 4d in FIG. 1B and also to recycle nozzle holder 5 back to its starting position adjacent die 2. It is to be understood that holder 5 may not need to be moved at all during cutting to make a straight cut. In a modification, holder 5 can be controlled as to its angle versus the extrusion direction.

Figure 2:
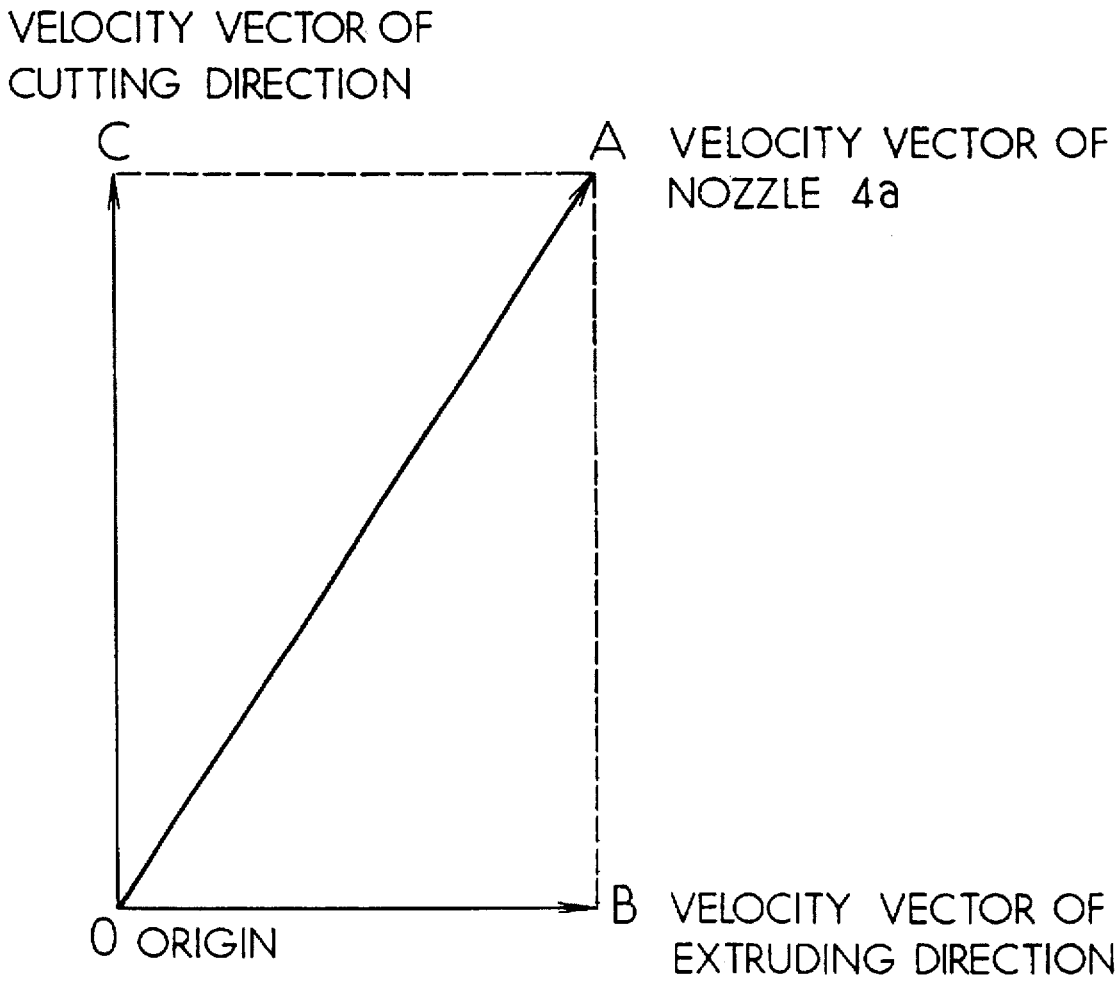
FIG. 2 is an explanatory vector diagram for a velocity vector of a high pressure water injection nozzle used in the embodiment.

In FIG. 2, velocity vector A of high pressure water injection nozzle 4a is expressed by a vector sum of a velocity vector B in the extruding direction of the undried honeycomb structure 3 and a velocity vector C which is perpendicular to the extruding direction 5a. If the moving velocity of holder 5 is B, i.e., the same as the extruding velocity vector, then A=C. However, if the velocity vector of the holder 5 is D, A=B+C+D. Further, when a small variation in the value of velocity vector C is detected by velocity detecting sensor 12 and in response thereto nozzle control 14 outputs a control signal for controlling the velocity of nozzle 4a, the undried honeycomb structure 3 is cut more accurately. If a control apparatus for maintaining a predetermined distance between nozzle 4a and the undried honeycomb structure 3 is further provided, undried clay material 3 can be cut even more accurately. This can be accomplished by making the nozzle track (not shown) in holder 5 the same shape as the honeycomb structure 3, for example, accurate.

The desired value of vector C is stored in the nozzle control device which is programmed to maintain that vector value constant by regulating the value of velocity vector A in response to signals from speed sensor 12 in order to obtain a flat cut which is perpendicular to the length of honeycomb structure 3.

The quality of the cutting process by high pressure water injected from high pressure water injection nozzle 4a is decided by the nozzle diameter, injecting pressure, value of velocity vector A, and the position of nozzle 4a relative to the of undried clay material 3.

The nozzle diameter of nozzle 4a and the injecting pressure define an injecting quantity. As the cutting force is increased in accordance with the injection quantity, a more desired smoother surface on the cutting face is obtained. However, if the injecting quantity becomes excessive, cells of the undried honeycomb structure 3 on the cutting surface are crushed, and the undried honeycomb structure 3 absorbs water, softens and deforms, and drying time in the downstream dryer is consequently increased due to the remaining water in the cell. On the other hand, if the injecting quantity becomes too small, the cutting force becomes small, remarkably reducing the cutting process, and it is not possible to obtain a favorable manufacturing surface.

The value of the velocity vector A has much influence in relation to the injecting quantity on the quality of the cutting surface. If the value of the velocity vector A is decreased, a more preferable smooth surface on the cutting face is obtained. However, the undried honeycomb structure 3 on the cutting face softens and deforms due to the remaining water in the cell. On the other hand, if the value of the velocity vector A is large, the productivity is improved; however, if the value of the velocity vector A is over a favorable value, the moving speed of nozzle 4a becomes too fast, and defective cutting is caused.

As a result of studying the influence of the nozzle diameter of nozzle 4a and the injection pressure based on the influence of the velocity vector A, the following desired ranges have been determined: the nozzle diameter of nozzle 4a should be 0.1–0.3 mm, the injection pressure should be 1000–3000 kg/cm$^2$, and the value of the velocity vector A should be 1–10 m/min.

Figure 3A:
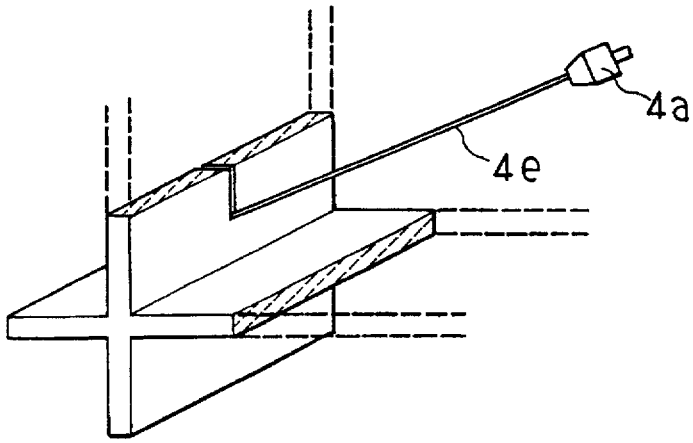
FIGS. 3A–3C are explanatory views showing an arrangement of the high pressure water injection nozzle in relation to undried clay material cell grids, FIG. 3A being a square cell grid, FIG. 3B being a triangle cell grid, and FIG. 3C being a hexagon cell grid.
Figure 3B:
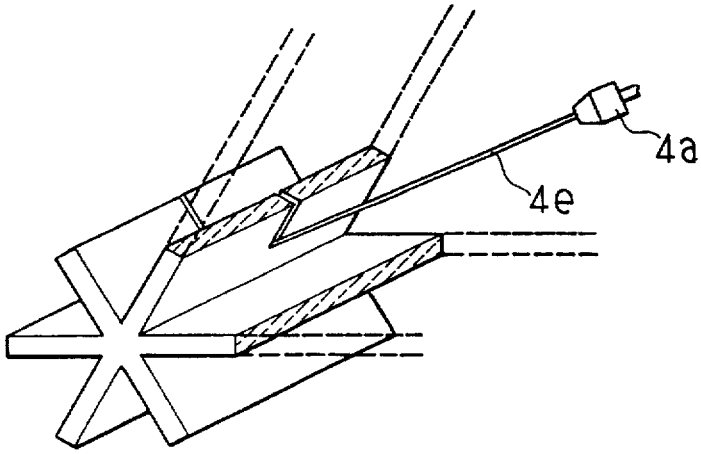
Figure 3C:
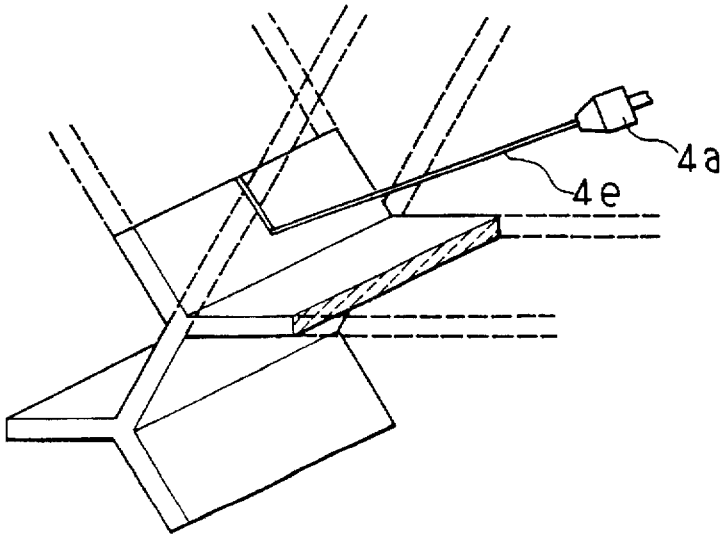

As for the relative arrangement of the undried honeycomb structure 3 and injection nozzle 4a, it should be noted that the undried honeycomb structure 3 is not a density homogeneous substance because it consists of cell grids forming cells and spaces. Therefore, to obtain a smooth cutting surface efficiently by a certain force under a predetermined nozzle diameter, injection pressure, and value of velocity vector A, nozzle 4a needs to be positioned relative to the undried honeycomb structure 3 so that the direction of the injected high pressure water is not included in a face of the cell grids. That is, as shown in FIGS. 3A–3C, the cutting water jet 4e is at an angle to the walls of the illustrated cell grids.

Conveyor 9 has an up and down moving mechanism as represented by arrows 9a in FIG. 1A and is illustrated in its up position. When conveyor 9 is in a down position, a receiving stand 7 is placed onto conveyor 9 near die 2, and then conveyor 9 is moved up and it holds the receiving stand 7 which in turn holds the undried honeycomb structure 3. While the undried honeycomb structure 3 is cut by high pressure water injected from high pressure water injection nozzle 4a, conveyor 9 keeps on holding receiving stand 7. After a predetermined length of the undried honeycomb structure 3 is cut off, the resultant cut body 6 which remains held on receiving stand 7 is transferred to conveyor 8.

While the undried honeycomb structure 3 is cut by high pressure water injected from high pressure water injection nozzle 4a, water is collected by collecting apparatus 10 shown in FIGS. 1A and 1B. Subsequently, clay substance in the collected water is removed, or the water is filtered, and then the water is discharged or recirculated.

In the above embodiment, receiving stands 7 serves as holding means and conveyors 8 and 9 serve as transferring means. However, these means are not limited to such structures since other structures such as air floating means operated by high pressure gas injection flow can perform these functions.

According to the present invention, the problems which occur in the conventional method for cutting honeycomb ceramic structures, for example, as shown in Japanese patent publication No. 4-60402, are overcome by using jet injection of high pressure water, instead of piano wire or the like, for the cutting procedure, with the jet injection being controlled in position so as to make a smooth non-deforming perpendicular cut.

The present invention has been described in connection with what is presently considered to be the most practical and preferred embodiment. However, the invention is not meant to be limited to the disclosed embodiment, but rather is intended to include all modifications and alternative arrangements included within the spirit and scope of the appended claims.

What is claimed is:

1. A curing method for cutting an undried clay material, said cutting method comprising the steps of:

forming an undried honeycomb structure of material from ceramic material; and cutting said undried honeycomb structure by injecting a jet of high pressure water across said undried honeycomb structure in a radial direction of said undried honeycomb structure and in a direction other than a direction included in an extended face of cell grids forming a cell of said undried honeycomb structure.

2. A cutting method according to claim 1, further comprising a step of controlling a direction of said jet of high pressure water before said cutting step.

3. A cutting method according to claim 1, wherein said forming step includes an extruding step for extruding said undried honeycomb body structure.

4. A cutting method according to claim 1, wherein said undried honeycomb structure is cut by moving said jet of high pressure water in a radial direction.

5. A cutting method according to claim 4, wherein said forming step includes an extruding step for extruding said undried honeycomb structure.

6. A cutting method according to claim 5, wherein said jet of high pressure water is injected while being moved in a direction where said undried honeycomb structure is extruded.

7. A cutting method according to claim 6, wherein a velocity vector A of said high pressure water is set to be a sum of a velocity vector B in an extruding direction of said undried honeycomb structure and a velocity vector C being vertical with an extruding direction of said undried honeycomb structure.

* * * * *